US007259316B2

(12) United States Patent
Kusumoto

(10) Patent No.: US 7,259,316 B2
(45) Date of Patent: Aug. 21, 2007

(54) EFFECT SYSTEM

(75) Inventor: Yoshinori Kusumoto, Kita-ku (JP)

(73) Assignee: Roland Corporation, Hamamatsu (JP)

( * ) Notice: Subject to any disclaimer, the term of this patent is extended or adjusted under 35 U.S.C. 154(b) by 507 days.

(21) Appl. No.: 10/816,765

(22) Filed: Apr. 2, 2004

(65) Prior Publication Data

US 2004/0194613 A1 Oct. 7, 2004

(30) Foreign Application Priority Data

Apr. 4, 2003 (JP) ..... 2003-102161

(51) Int. Cl.
*G10H 7/00* (2006.01)
*G10H 1/02* (2006.01)

(52) U.S. Cl. ..... 84/630; 84/612

(58) Field of Classification Search ..... 84/612, 84/630, DIG. 6; 381/63; 360/54
See application file for complete search history.

(56) References Cited

U.S. PATENT DOCUMENTS 5,430,243 A * 7/1995 Shioda ..... 84/645
5,973,255 A * 10/1999 Tanji ..... 84/636

FOREIGN PATENT DOCUMENTS

JP 04-316540 5/1994

* cited by examiner

*Primary Examiner*—Jeffrey W Donels
(74) *Attorney, Agent, or Firm*—Foley & Lardner LLP

(57) ABSTRACT

An effect system stored a specified segment of an audio signal and repeats the segment during a specified interval. The segment length may be defined in advance as a musical time interval and the interval in which it is repeated may be defined in advance as a musical time interval or as a number of repetitions. The beginning of the segment may be defined in advance as a location in musical time within the audio signal, or may be indicated manually during performance.

17 Claims, 7 Drawing Sheets

Processing launched by timer interrupt of T3

EFFECT SYSTEM

BACKGROUND OF THE INVENTION

1. Field of the Invention

Embodiments of the present invention relate effect systems that produce a delay in an audio signal.

2. Related Technology

A delay is a type of audio effect. In the typical delay system, an input signal is written to memory, and then after a time delay is read out and output. This produces a delay effect in which the input signal is delayed for a defined period of time and then output.

The type of delay used in real-time performance typically includes a feedback means that feeds the output signal back to the input, and an addition means that adds the fed-back signal to the input signal. This cycle of input, delay, output and feed back produces a repeating or looping effect. An example of such a system is provided in Japanese Unexamined Patent Application Publication (Kokai) Number Hei 6-149278.

Because this system produces the repeating effect through the combination of a delay and a feedback loop, it is not possible to simply repeat a segment of the input signal without cumulative addition of subsequent signal.

Consequently, if the performer wishes to repeat a passage during a real-time performance, it is necessary to sample that passage prior to the performance and set it up for output by some other type of device. Thus the performer cannot use such a repeating effect for a passage that is produced in real time.

SUMMARY OF THE INVENTION

Embodiments of the invention enable the performer to apply a repeating effect (also referred to as loop output) to a passage generated during a real time performance without using feedback and cumulative addition to generate the repeating effect. The performer is enabled to produce a repeating effect solely for a passage that is produced in real time during the performance.

In accordance with one embodiment of the invention, user input is used to define in advance the length of a segment to be repeated, and the v interval during which it is repeated. The length of the segment may be defined in units of musical time. The interval during which the segment is repeated may be defined in units of musical time or as a number of repetitions to be produced. The starting point of the segment may be defined in advance as a location in musical time. Alternatively, the performer may indicate the starting point manually during performance. The performer may also terminate the repetition of the segment manually.

From the user input, the device in accordance with this embodiment of the invention stores a segment of an audio signal as it is being output, and then repeatedly outputs that segment in a looping fashion in accordance with the specified output interval. Thus a repeating or delay effect is achieved without cumulative addition of subsequent input to the repeated portion of the signal.

DETAILED DESCRIPTION OF PREFERRED EMBODIMENTS

Figure 1:
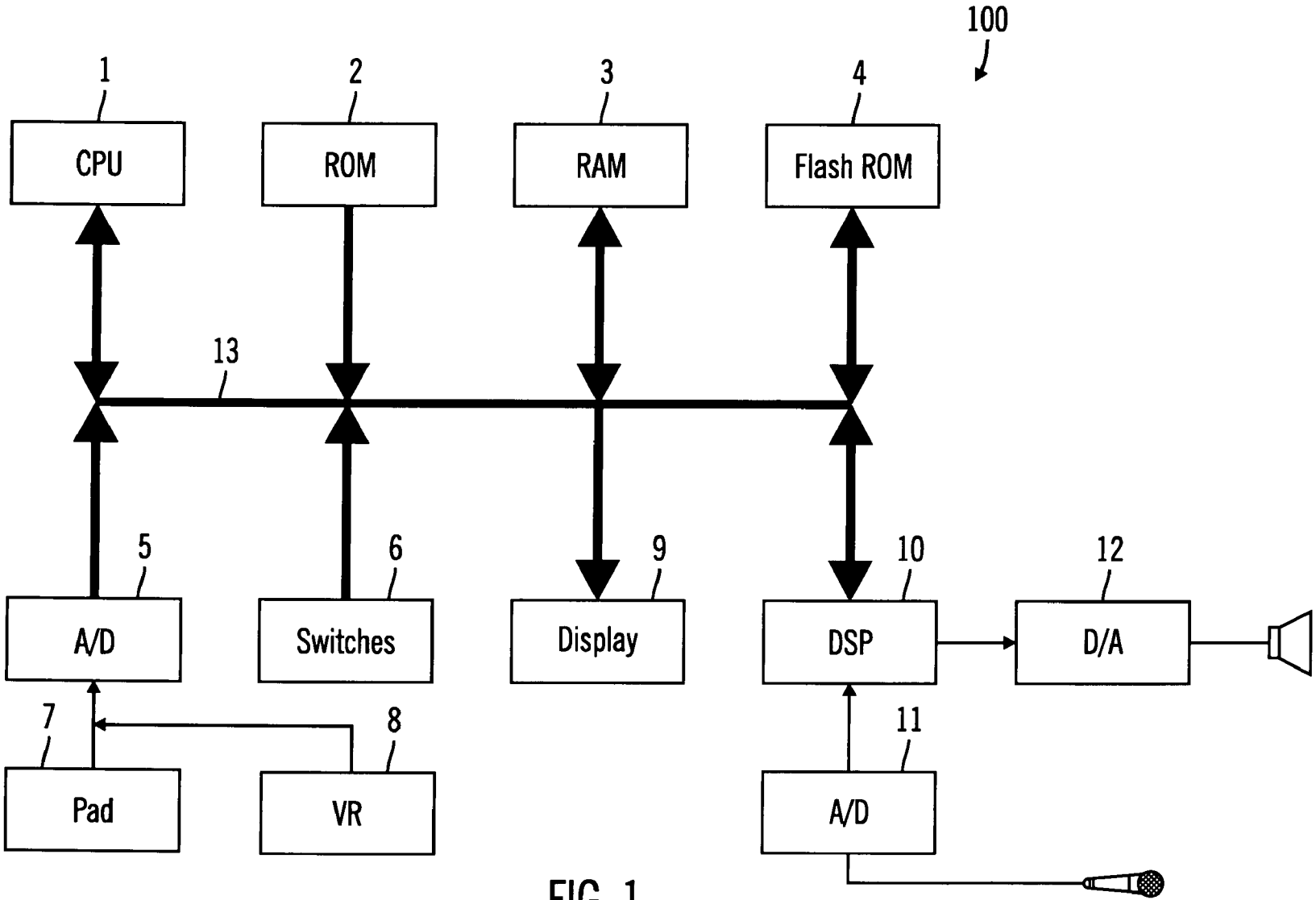
FIG. 1 shows hardware components of an electronic musical instrument that includes an effect system in accordance with a preferred embodiment of the invention.

An explanation will be given below regarding a preferred embodiment of the present invention while referring to the attached drawings. FIG. 1 is a block drawing that shows in outline the electrical configuration of an electronic musical instrument 100 that has the effect system of one preferred embodiment of the present invention installed.

The electronic musical instrument 100 has installed in it primarily the CPU 1, the ROM 2, the RAM 3, the flash ROM 4, the analog to digital converter (A/D) 5 that converts the analog signal that is input from the pads 7 or VR (variable resistor) 8 into a digital signal, the switches 6, the display device 9, the DSP 10, the bus line 13, which interconnects each of these structures, the analog to digital converter (A/D) 11 that converts the analog signals that have been input from a microphone or an electronic musical instrument and the like into digital signals for processing by the DSP 10, and the digital to analog converter (D/A) 12 that converts the digital signal that has been input from the DSP 10 into an analog signal for emission as a musical tone through a speaker and the like.

Figure 5:
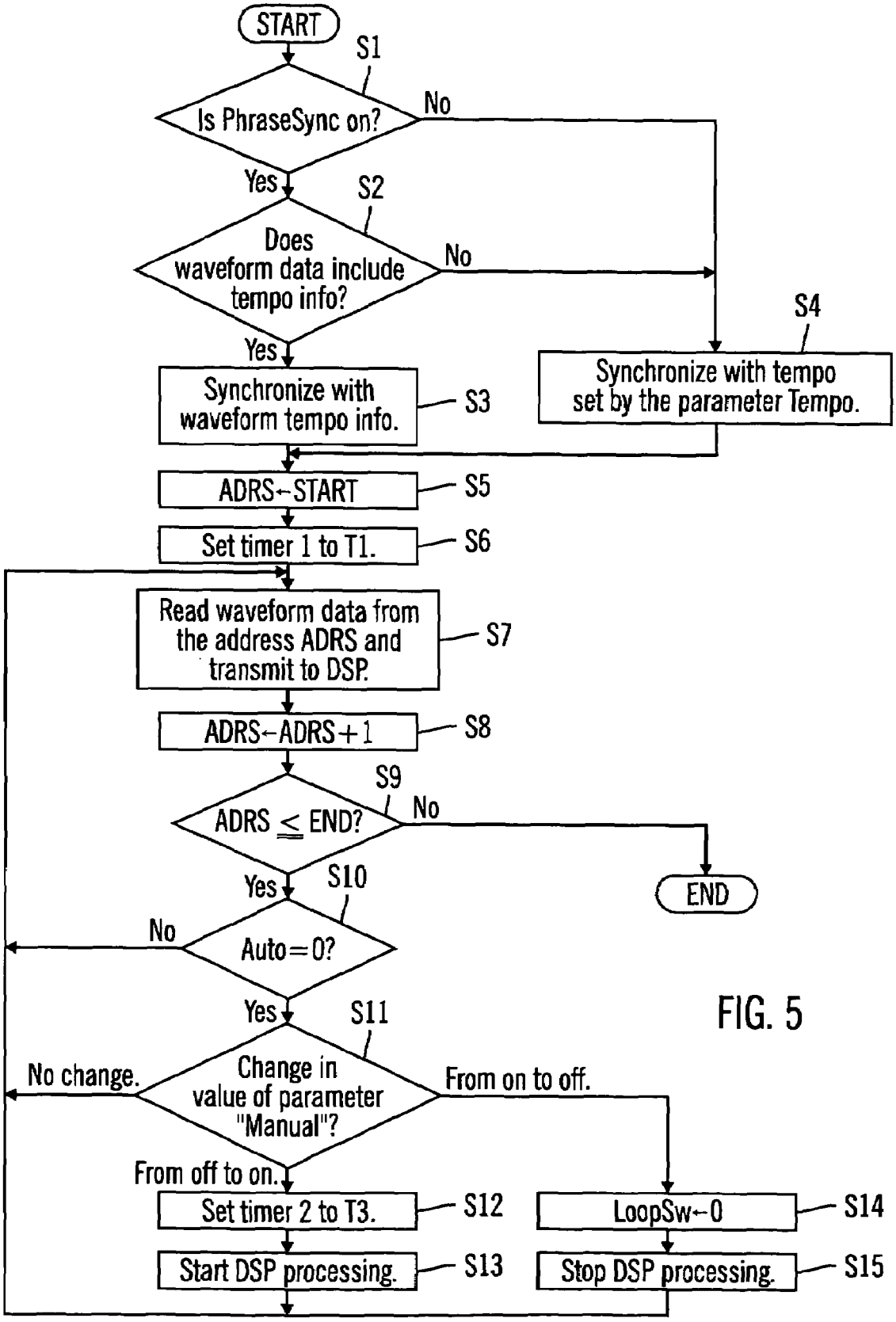
FIG. 5 is a flowchart that shows main processing that is executed in accordance with the preferred embodiment.
Figure 6:
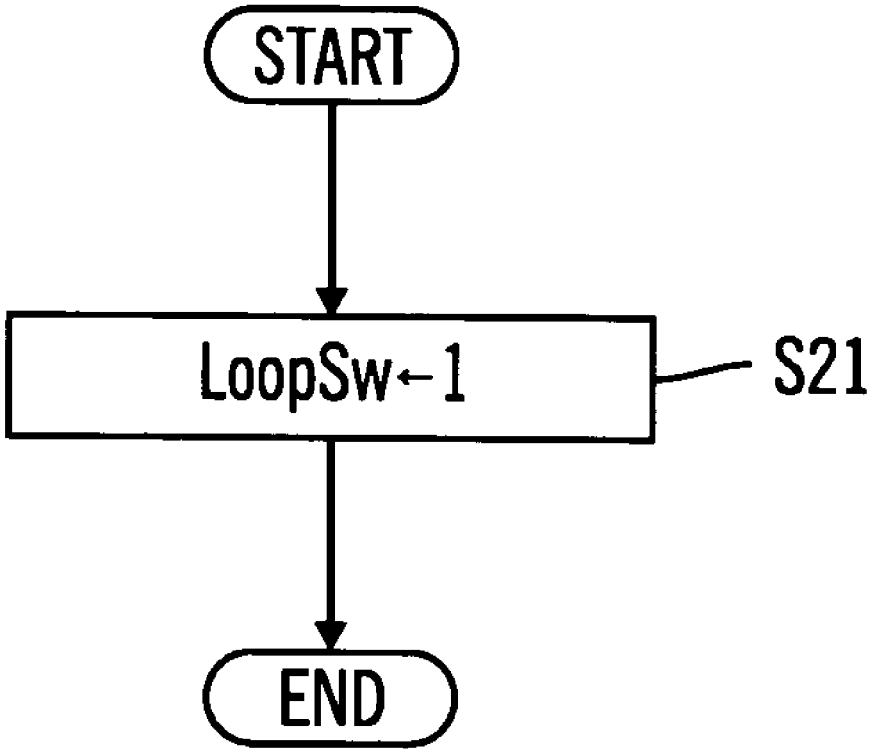
FIG. 6 is a flowchart that shows processing that is launched by the timer interrupt of the time T3.
Figure 7:
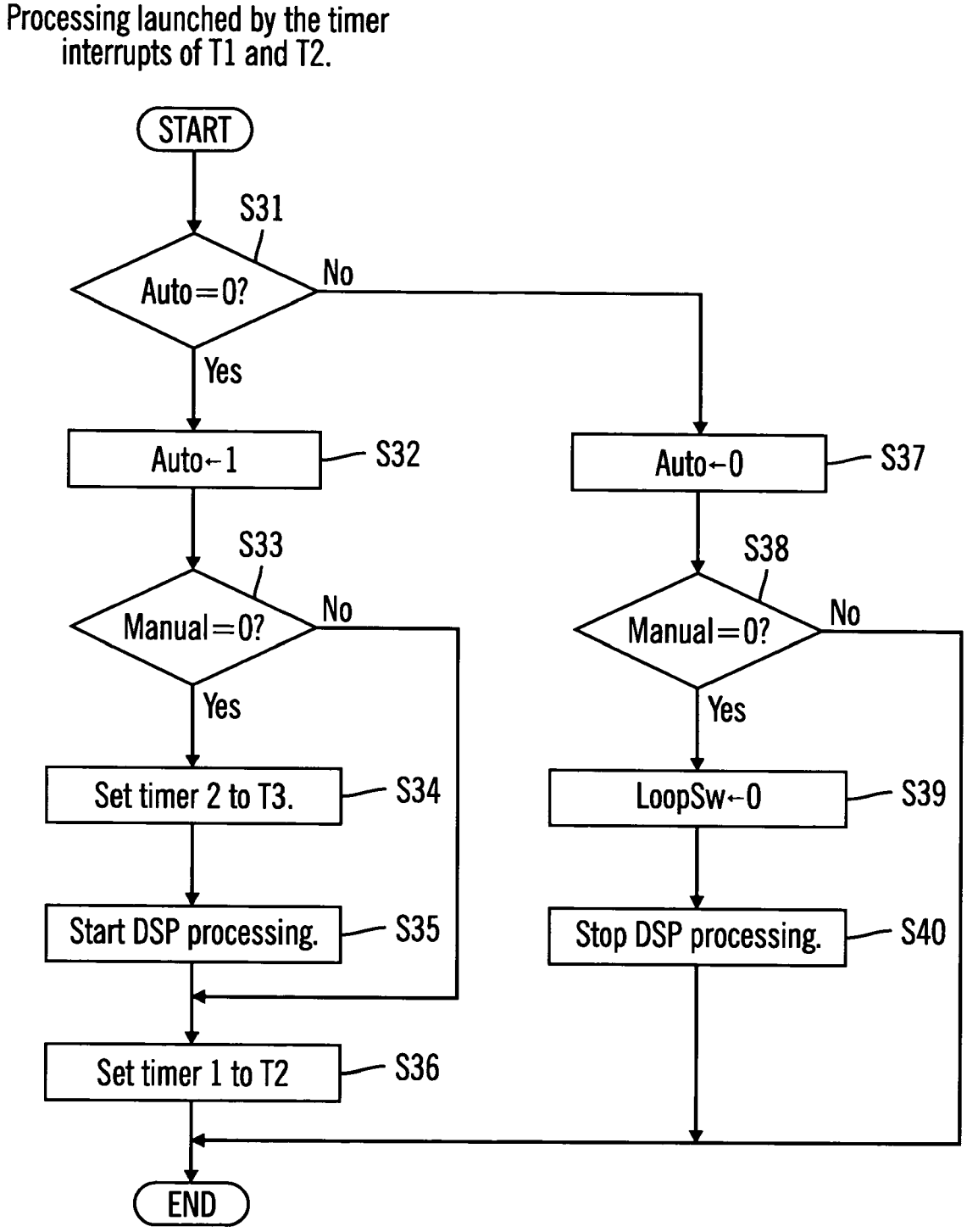
FIG. 7 is a flowchart that shows processing that is launched by the timer interrupt of the times T1 and T2.

The CPU 1 is a central processing unit that controls the entire effect system and the various kinds of control programs that are executed by the CPU 1. Fixed value tables and the like that are referenced at the time of this execution are stored in the ROM 2. The RAM 3 is a writable memory that can be accessed randomly and has a working area with the various kinds of register groups that are needed for the control programs which are executed by the CPU 1, a temporary area in which the data are stored temporarily during processing, and the like. Programs of the flowcharts that are shown in FIG. 5 through FIG. 7 are stored in the ROM 2 as a portion of the control programs.

The flash ROM 4 is a writable non-volatile memory in which a plurality of waveform data and various kinds of parameters related to those waveform data as well as a plurality of patches (the timbre information that includes the assignment of the waveform data to the pads 7*a* through 7*f*) are stored. In the flash ROM 4, the waveform data (the musical tone data) for the presets are stored and, together with this, waveform data that have been sampled by the performer are also stored. Incidentally, the flash ROM 4 may comprise a removable memory card such as a Compact Flash (™) and the like.

The switches 6 are an operator group with which the parameter settings and the mode settings are carried out. With the effect system of this preferred embodiment, the patch button 21, the edit button 22, the effects button 23, the manual button 24, the parameter buttons 26 and 27, the DEC button 28, the INC button 29, the exit button 30, the enter button 31, and the like are included as the relevant switches (refer to FIG. 2).

Figure 2:
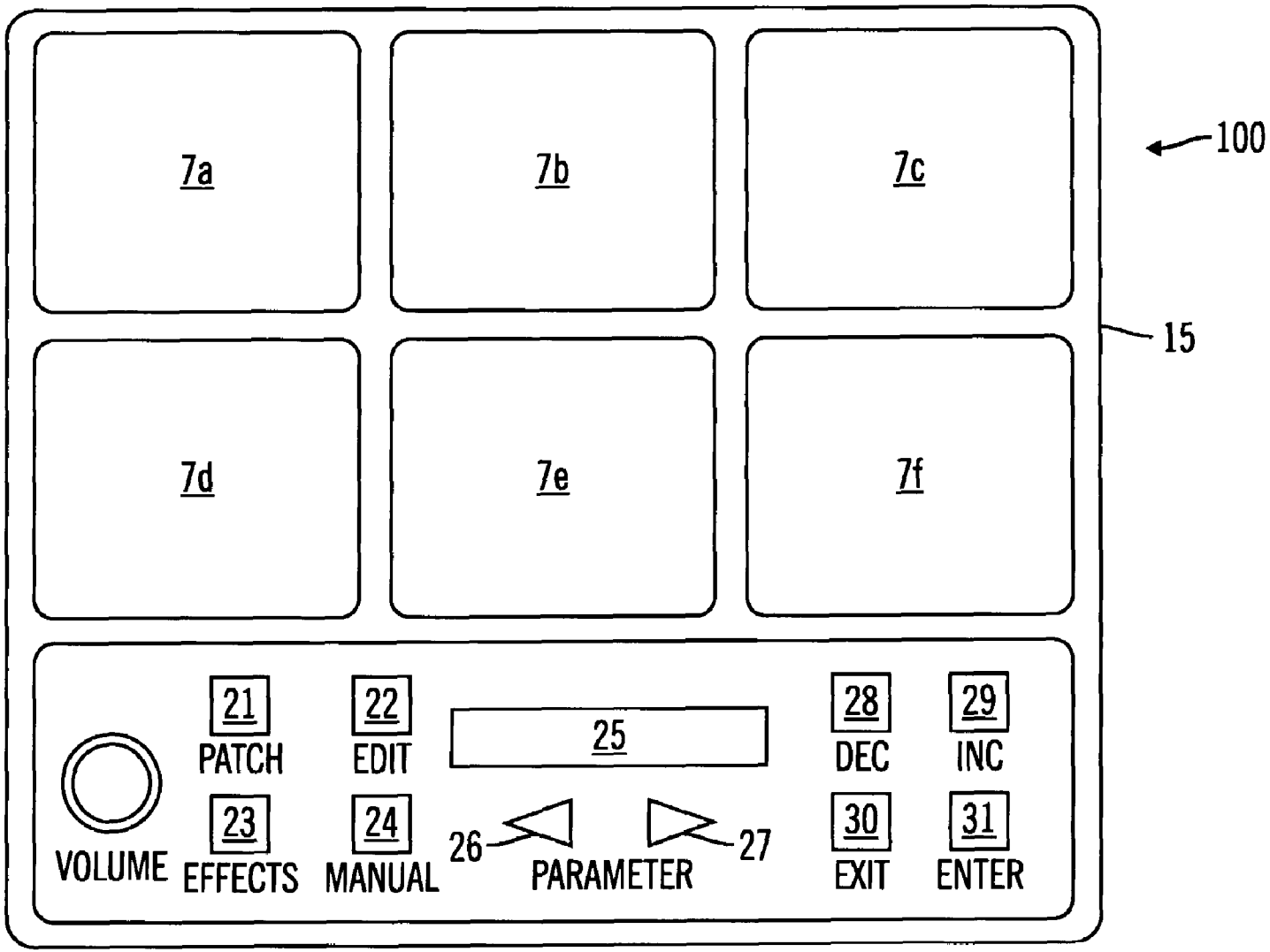
FIG. 2 shows the operating panel of an electronic musical instrument that includes the effect system of the preferred embodiment.

The pads (striking surfaces) 7 comprise the six pads 7*a* through 7*f* (refer to FIG. 2). The striking sensors (for example, piezo elements), which are not shown in the drawing, are furnished on the rear surfaces of the pads 7 (pads 7*a* through 7*f*). The vibrations that are produced due to the striking of a pad 7 are captured by the striking sensor and output as an analog electrical signal (a trigger signal) to the A/D 5. The analog electrical signal that has been input to the A/D 5 is converted into a digital signal and that digital signal is detected in the CPU 1.

The VR 8 is a variable resistor such as the volume control 20 (refer to FIG. 2) for adjusting the volume (the output level) or the pedal (not shown in the drawing) for regulating the volume (the output level). The analog electrical value that is output by means of the operation of the VR 8 is input to the A/D 5 and converted into a digital value and that digital value is detected in the CPU 1.

The DSP 10 is a digital signal processor for processing the waveform data (the musical tone data) of the digital signal. The DSP 10 outputs the waveform data that have been sampled from a microphone or an electronic musical instrument and the like and have been digitized by the A/D 11 to the flash ROM 4 and, together with this, applies a specified effect to the digital waveform data that have been read out from the flash ROM 4 and outputs this to the D/A 12.

FIG. 2 is a front elevation drawing of the operating panel 15 of the electronic musical instrument 100 in which the effect system of the present invention is installed. As is shown in FIG. 2, the volume control 20 is provided as the VR 8 discussed above (refer to FIG. 1), the various kinds of buttons 21 through 24 and 26 through 31 are provided as the switches 6 discussed above (refer to FIG. 1), and the display 25 is provided as the display device 9 discussed above. In addition, on the upper portion of the operating panel 15, as is shown in FIG. 2, the pads 7 discussed above (refer to FIG. 1) that comprise the six pads (striking surfaces) 7*a* through 7*f* are disposed.

The volume control 20 is a knob for controlling the volume (the output level), and the patch button 21 and the edit button 22 are buttons for shifting to the patch mode and the edit mode, respectively. In addition, the effect button 23 is a button for applying an effect.

The manual button 24 is a button to which the parameter Manual, which will be discussed later, is assigned and is configured such that the parameter Manual is toggled on and off with each pressing of the relevant manual button 24.

The display 25 is for displaying the operating state of the electronic musical instrument 100 (various kinds of operating mode information, various kinds of parameter values and the like). For example, a screen is displayed that corresponds to each of the operating modes that have been selected by pressing the patch button 21 and the edit button 22.

The parameter buttons 26 and 27 are switches for the selection, in each of the screens that are displayed on the display 25, of a page shift on the screen and a parameter from among the various kinds of parameters that are displayed on the display screen. Incidentally, each of the parameters will be discussed in detail later. The value of each parameter that has been selected by the parameter button 26 and 27 is decreased by "1" by pressing the DEC button 28, or conversely, increased by "1" by pressing the INC button 29, and output.

The exit button 30 is a button for returning the display screen one level previous for each of the display screens that are displayed by the display 25, and the enter button 31 is a button for confirming the value that has been input.

Figure 3:
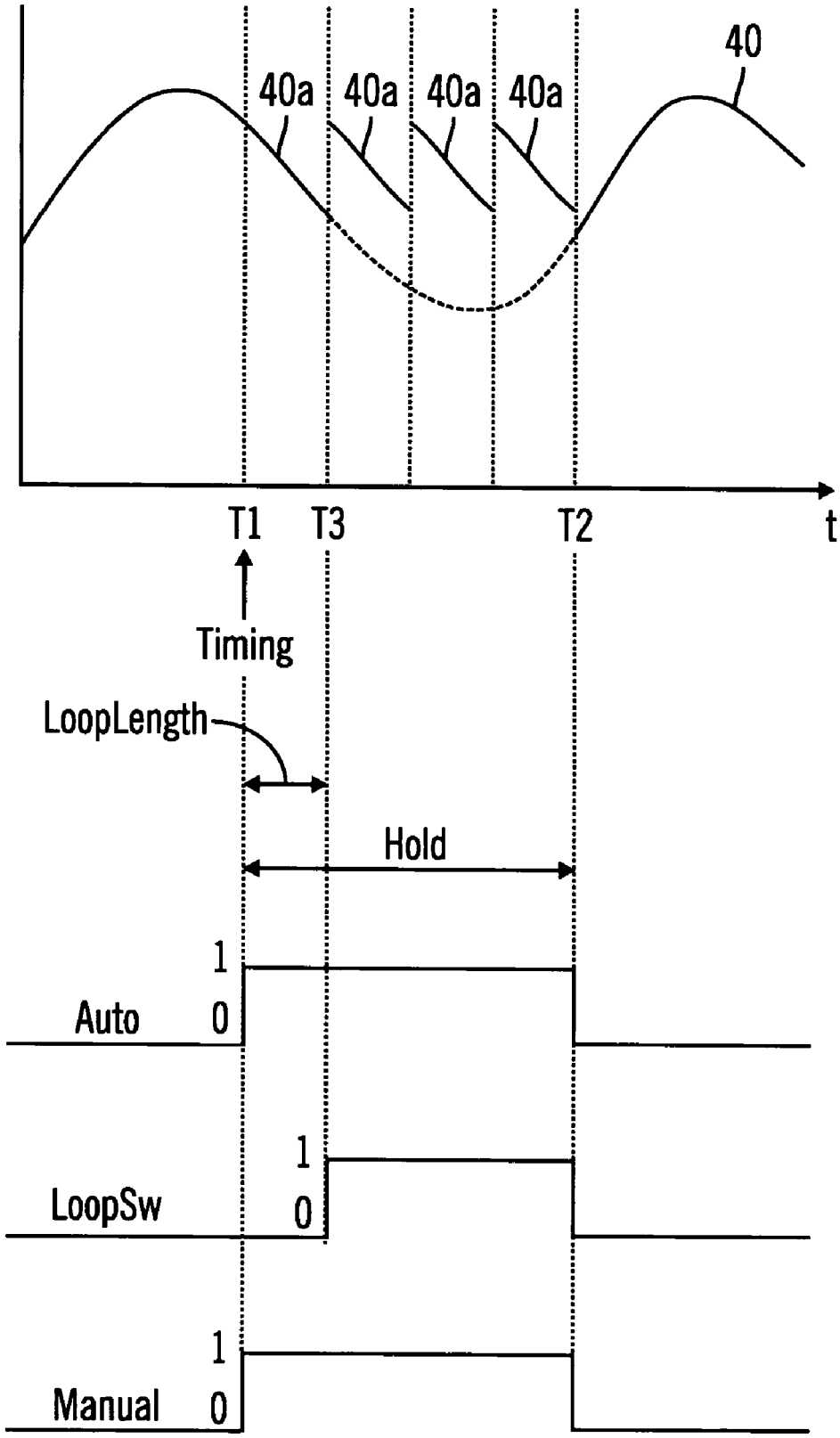
FIG. 3 shows the output signal waveform produced by the effect system of the first preferred embodiment.

Next, an explanation will be given regarding the essentials and each parameter, and the like of the effects related to the effect system of the present invention while referring to FIG. 3. FIG. 3 is a schematic drawing in which the output signal waveform using an electronic musical instrument that has the effect system of the present invention installed is shown schematically on a time interval axis.

As shown in FIG. 3, the effect system is configured such that a segment 40*a* of the source signal 40 is repeated during a specified interval. In the example of FIG. 3, the segment 40*a* is defined as the portion of the source signal 40 between time T1 and time T3, and is defined as repeating during the interval between time T1 and T2.

In the preferred embodiment, the length of the segment (Loop Length) and the length of the interval in which it is repeated (Hold) are set by the performer in advance, while the time at which the segment begins (T1) may be set in advance or may be indicated manually in real time during performance.

The parameter Loop Length, as is shown in FIG. 3, defines the length of the segment 40*a* of the source signal 40 that is stored and repeated. In the preferred embodiment, the Loop Length is specified by the performer as a number in the range of "0 to 127."

The parameter Hold, as is shown in FIG. 3, defines the length of the interval (T1 to T2) during which the segment is repeated. In the preferred embodiment, the Hold parameter is designated in note lengths (for example, 32nd notes, 16th notes, 8th note triplets, dotted 16th notes, eighth notes, quarter note triplets, dotted eighth notes, quarter notes, half note triplets, half notes, dotted half notes, and whole notes). Therefore, it is possible to make the length of the interval musically easy to understand.

In manual mode, the start time of the segment is indicated by a start signal that is generated by the performer pressing a manual start button 24 as described above. In automatic mode, the start time is set in advance using the parameter Timing and the segment is automatically stored and repeated in synchronization with tempo information obtained from the source signal. The parameter Timing is set to a number in the range of "1 to 16" to indicate the timing of the beginning of the segment in 16th note units within the bar when an automatic loop mode is used. Timing can also be set to "off," to turn off the automatic mode. The device may also be toggled between manual and automatic mode using the Manual button 24.

The Loop Length and Hold interval are measured with respect to tempo information. In cases where the source signal includes tempo information, the loop output is synchronized to the tempo indicated in the source signal, unless the parameter Phrase Sync is set to "off." In cases where the parameter Phrase Sync is set to "off," or in cases where the source signal does not include tempo information, the loop output is synchronized to a tempo specified in advance by the performer. In the preferred embodiment, the parameter Tempo is specified by the performer as a number in the range of "20 to 260."

The parameters described above control flags that are stored in RAM 3 to indicate the status of various device modes. These flags are shown in FIG. 3. The flag Auto is a flag that indicates whether or not the loop output is being done in automatic mode. The flag Auto is set to "0" in its initial state. In those cases where an automatic loop has been started, the flag is set to "1" during the hold interval. When the automatic loop has terminated, the flag is set to "0."

The flag Manual is a flag that indicates the state of the parameter Manual that has been assigned to the manual button 24 discussed above. As is shown in FIG. 3, in those cases where the parameter Manual has been set on (in other words, a loop output by means of a manual loop has been designated), the flag is set to "1" during the interval while the manual button 24 is set on. When the parameter Manual has been set off (in other words, the designation of the loop output by means of a manual loop has been canceled), the flag is set to "0."

The flag Loop Sw indicates whether the current time is within the hold interval during which loop output of the stored segment is performed in manual mode or automatic mode. In other words, during the interval in which the stored segment is repeatedly read out and output from the buffer (the segment from the time "T3" to the time "T2"), the Loop Sw flag is set to "1." At other times (including also the initial loop segment described before), the Loop Sw flag is set to "0."

Here, an explanation will be given regarding the roles of the CPU 1 and the DSP 10. After a note on, the CPU 1 reads out the source signal (the waveform data) from the flash ROM 4 and supplies this to the DSP 10. The DSP 10, while storing the source signal 40 that has been supplied to a buffer in the RAM 3, which is a region that is reserved, outputs the source sound signal that has been supplied to the outside from a speaker and the like via the D/A 12.

When the flag Loop Sw is set to "1" (in other words, in the interval from the time "T3" to the time "T2"), the DSP 10 repeatedly reads out the signal 40*a*, which corresponds to the specified segment (the segment from the time "T1" to the time "T3") from the signal that has been stored in the buffer discussed above and outputs the signal 40*a* that has been read out to the outside from a speaker and the like via the D/A 12. As a result, it is possible to apply an effect in real time in which the signal 40*a* of a specified segment from a specified timing for the source signal 40 is repeated and output.

Incidentally, in FIG. 3, it has been drawn such that the change of the flag Auto and the change of the flag Manual are the same; however, this is a convenience to indicate the relationship between the change of the flag and the loop operation. In actuality, since the flag Auto changes in conformance with the automatic loop operation and the flag Manual changes in conformance with the manual loop operation, the two both change independently. As will be explained later with the flowchart, the automatic loop and the manual loop operate as a logical OR. That is to say, if at least one of the flag Auto or the flag Manual is shown as "1," storage to the buffer is started and the loop operation is carried out. If both flags are shown as "0," the readout from the buffer stops and the loop operation terminates.

Figure 4A:
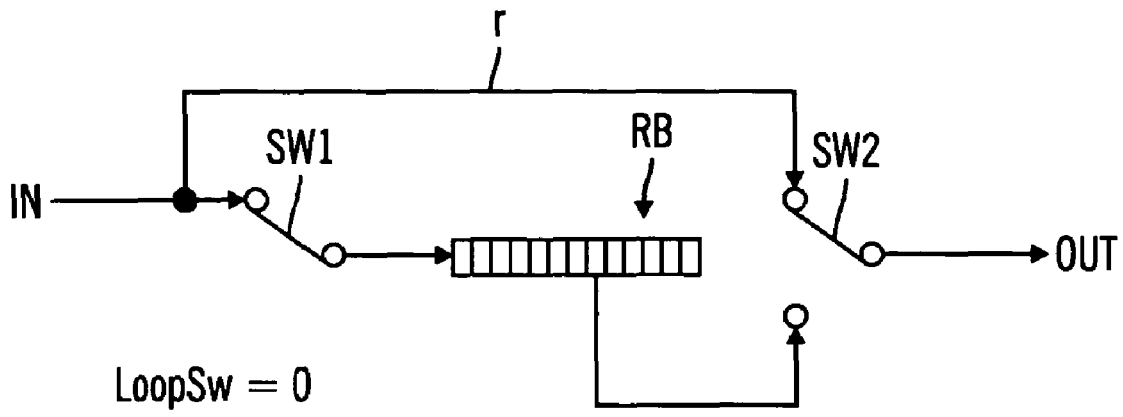
FIG. 4*a* and FIG. 4*b* provide a schematic illustration of segment storage and output.
Figure 4B:
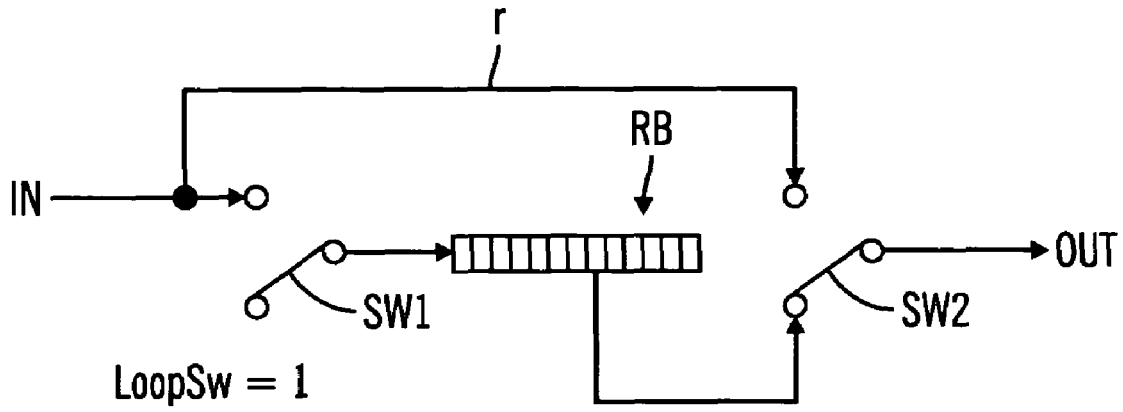

An explanation will be given here regarding the principles of the effect that is related to the effect system of the present invention while referring to FIG. 4. FIG. 4 is a schematic drawing that shows the principles of the loop effect produced by the present embodiment. FIGS. 4(*a*) and 4(*b*) correspond to the cases where the value of the flag Loop Sw is "0" and "1," respectively.

The two switches SW 1 and SW 2 are configured such that they are linked to and toggled by the value of the flag Loop Sw. In those cases where the value of the flag Loop Sw is "0," as is shown in FIG. 4(*a*), the switches SW 1 and SW 2 are toggled upward. As a result, the wave data that are input on the IN side are stored in sequence in the buffer RB for the loop, and are also output to the outside from the OUT side via the path r. This state exists in the period between a note on and time T3, and in the period after time T2. The amount that is buffered by the loop buffer RB corresponds to the value set for the parameter Loop Length.

On the other hand, when the value of the flag Loop Sw is "1," as shown in FIG. 4(*b*), the switches SW 1 and SW 2 are toggled down. As a result, the path through which the IN side and OUT side are connected is opened and, in this case, the waveform data that were stored in the loop buffer RB during the time that the value of flag Loop Sw was "0" are repeatedly read out and output through the OUT side. This state exists in the period between times T3 and T2 in FIG. 3.

Next, an explanation will be given regarding the processing that is executed by an effect system that is configured as described above while referring to the flowcharts that are shown in FIG. 5 through FIG. 7. This explanation will refer to FIG. 3 and FIG. 4 as appropriate.

FIG. 5 is a flowchart that shows the main processing that is executed in an electronic musical instrument that has the effect system of the present invention installed. This processing is processing that is executed by the CPU 1 in those cases where there is a note on, in other words, in those cases where a striking of the pad 7 has been detected and is processing for applying an effect that corresponds to the setting state of each of the parameters and flags and the like to the waveform data and outputting this to the outside through a speaker and the like.

With regard to the main processing, the CPU 1 first determines whether or not the value of the parameter Phrase Sync is on (S1). In those cases where the result is that it has been determined that the value of the parameter Phrase Sync is on (S1: yes), this means that synchronization with the tempo information that is possessed by the waveform data of the effect using the effect system is instructed. Therefore, in this case (S1: yes), a determination is made as to whether or not the waveform data that have been read out from the flash ROM 4 possess tempo information (S2); and, in those cases where it has been determined that the waveform data possess tempo information (S2: yes), after making the setting such that the effect from the effect system is synchronized with the tempo possessed by the waveform data (S3), the processing moves to the processing of S5.

On the other hand, in those cases where it has been determined in the S1 processing that the value of the parameter Phrase Sync is not on (S1: no), synchronization with the tempo information that is possessed by the waveform data of the effect using the effect system is not instructed; and, in addition, even in those cases where the relevant synchronization has been instructed (S1: yes), in those cases where the waveform data do not posses tempo information (S2: no), since synchronization with the tempo information is not possible in these cases (S1: no or S2: no), after the effect using the effect system has been set such that the effect is synchronized with the tempo that has been set by the parameter tempo (S4), the processing moves to the processing of S5.

In the processing of S5, the value of the start point Start of the waveform data is stored in the readout address Adrs (S5), and the processing moves to the processing of S6. Here, the readout address Adrs is a register that is provided in the CPU 1 and the start point Start is the starting address value of the waveform data in the flash ROM 4. Incidentally, the end point End, which will be discussed later, is the ending address value of the waveform data in the flash ROM 4.

The processing of S6 sets the time of the timer 1 "T1" (S6). In those cases where the loop output by means of an automatic loop is carried out, the time "T1" is a time that indicates the timing that starts the loop output (refer to FIG. 3) and is set by the parameter Timing. In those cases where it has been determined by the clock of the timer 1 that timing of the time "T1" has arrived, the control that is being executed by the CPU 1 is temporarily interrupted and the timer interrupt processing that is shown in the flowchart of FIG. 7 is executed. The details of the timer interrupt processing will be discussed later.

In addition, in those cases where the value of the parameter Timing is set to "off," the clock of the time "T1" is not carried out by the timer 1; and, therefore, since the timer interrupt processing that is shown in the flowchart of FIG. 7 is not executed, the loop output by means of an automatic loop is not carried out.

After the time "T1" has been set in the S6 processing, the waveform data from the address location in the flash ROM 4 that corresponds to the value of the readout address Adrs is read out and the waveform data that have been read out are transmitted to the DSP 10 (S7).

If the DSP 10 that has received the waveform data is not in the midst of a loop output by means of an automatic loop or a manual loop, the waveform data that have been received are output to the outside from a speaker and the like via the D/A 12 while being stored in the buffer that has been reserved in a region of the RAM 3 (refer to FIG. 4(*a*)). On the other hand, if the system is in the midst of a loop output by means of an automatic loop or a manual loop, the DSP 10 repeatedly reads out and outputs the waveform data that have been stored in the buffer discussed above (refer to FIG. 4(*b*)). Therefore, in this case, the waveform data that have been received are ignored.

After the waveform data have been transmitted to the DSP 10 (S7), "1" is added to the value of the readout address Adrs (S8) and a determination is made as to whether or not the value of the readout address Adrs after the addition exceeds the value of the end point End (S9).

In those cases where the result is that a determination is made that the value of the readout address Adrs does not exceed the value of the end point End (S9: yes), since this means that the readout of the waveform data from the flash ROM 4 has not yet ended, the remaining waveform data should be read out and the processing moves to the processing of S10. On the other hand, in those cases where the determination is that the value of the readout address Adrs has exceeded the value of the end point End (S9: no), since this means that the readout of all of the waveform data from the flash ROM 4 has been completed, the main processing terminates.

In the processing of S10, a determination is made as to whether or L not the value of the flag Auto is "0." In those cases where the result is that a determination is made that the value of the flag Auto is "0" (S10: yes), either a loop output by means of an automatic loop has not been instructed (in other words, the parameter Timing is made off) or a loop output by means of an automatic loop has been instructed but the timing of the time "T1" has not yet been reached and the loop output by means of an automatic loop has not been started or the loop output by means of an automatic loop has already ended (refer to FIG. 3). Therefore, in this case (S10: yes), this should correspond to a manual loop and the processing shifts to the processing of S11.

On the other hand, in the processing of S10, in those cases where it has been determined that the value of the flag Auto is "1" (S10: no), the system is in the midst of a loop output by means of an automatic loop (refer to FIG. 3). In this case, the processing returns to the processing of S7 and, during the time until the loop output by means of an automatic loop ends (S10: yes), the processing of S7 through S9 is executed repeatedly. In this manner, even during the loop output by means of an automatic loop, due to the continued sequential readout of the waveform data (corresponding to the source sound signal 40 in the segment from the time "T1" to the time "T2" of FIG. 3) from the flash ROM 4, it is possible to appropriately match the readout position (the position of the time "T2" of FIG. 3) of the data in those cases where the loop output by means of an automatic loop has ended to the timing of the beat.

In the processing of S11, a determination is made as to whether or not there has been a change in the value of the parameter Manual, in other words, whether or not the manual button 24 has been operated (S11). In those cases where the result is a determination that there has not been a change in the value of the parameter manual (S11: "no change"), there has not been an operation of the manual button 24 carried out by the performer; and, therefore, since a loop output by means of a manual loop has not been instructed, a normal performance should continue and the processing returns to the processing of S7.

On the other hand, in those cases where, in the processing of S11, a determination is made that the value of the parameter Manual has changed from "off" to "on" (S11: "from off to on"), the manual button 24 has been pressed and operated by the performer and an instruction has been made to start a loop output by means of a manual loop. Incidentally, due to the relevant start instruction, the value of the flag Manual is set to "1" (refer to FIG. 3).

Therefore, in this case (S11: "from off to on"), the time T3, which is determined by the parameter Loop Length, is set in the timer 2 (S12) and, after the length of the sound that is looped (corresponding to the signal 40*a* of FIG. 3) has been set, the processing moves to the processing of S13. Incidentally, in those cases where a determination has been made by the clock of the timer 2 that the timing of the time T3 has arrived, the CPU 1 interrupts the control that is being executed and executes the timer interrupt processing that is shown in the flowchart of FIG. 6. An explanation will be given here regarding the timer interrupt processing while referring to FIG. 6.

FIG. 6 is a flowchart that shows the processing that is launched by the timer interrupt of the time "T3." When the timing of the time T3 arrives, the CPU 1 sets the value of the flag Loop Sw to "1" (S21) and the timer interrupt processing ends. Incidentally, after the completion of the timer interrupt processing, the control returns to the position of the interruption of the control that was being executed prior to the interruption and the control resumes from that interrupt position.

The explanation will be given returning to FIG. 5. In the processing of S13, a loop output by means of a manual loop should be started, and the start of the relevant loop output is instructed to the DSP 10 (S13). By means of the start instruction, the DSP 10, as has been discussed above, while storing the waveform data supplied by the CPU 1 during the time that the flag Loop Sw is "0" (in other words, during the time from the setting of the value of the flag Manual to "1" until the time "T3"), outputs the waveform data that have been supplied to the outside from a speaker and the like via the D/A 12 (refer to FIG. 4(*a*)).

In addition, in those cases where the flag Loop Sw has become "1" (in other words, during the time from the time "T3" in FIG. 3 until the value of the flag Manual drops to "0"), the signal that is stored in the buffer discussed above (the signal 40*a* that corresponds to the segment from when the value of the flag Manual has become "1" until the time "T3") is repeatedly read out and the signal that has been read out is output to the outside from a speaker and the like via the D/A 12 (refer to FIG. 4(*b*)).

As a result, the effect system of the present embodiment applies an effect to the waveform data in which the signal of a specified segment (in other words, the length that has been set by the performer by means of the parameter Loop Length) from the specified timing of the waveform data (in other words, the timing that has been produced by the performer pressing and operating the manual button 24) is repeated and output in real time only during the time that is specified (in other words, as will be discussed later, until the performer again carries out the pressing and operation of the manual button 24).

In the processing of S13, after the instruction has been made to the DSP 10, the processing returns to the processing of S7 and, as will be discussed later, during the time until there is an instruction to stop the loop output by means of a manual loop (S11: "from on to off"), the processing from S7 through S9 is repeatedly executed.

In this manner, due to the fact that the waveform data continue to be read out sequentially from the flash ROM 4 (corresponding to the original sound signal 40 in the segment from when the value of the flag Manual has been set at "1" to the time "T2") even during a loop output by means of a manual loop, it is possible to restore the readout position of the waveform data in those cases where the loop output by means of a manual loop has been completed (the position at which the value of the flag Manual has dropped to "0") to the original appropriate position.

In addition, in those cases where a loop output by means of an automatic loop has been started during a loop output by means of a manual loop, it is possible to have the readout position of the waveform data in those cases where the loop output by means of an automatic loop has ended appropriately agree with the timing of the beat.

In those cases where, in the processing of S11, a determination is made that the value of the parameter Manual has changed from "on" to "off" (S11: "from on to off"), this means that the pressing and operation of the manual button 24 has again been carried out by the performer and an instruction to the effect that the loop output by means of a manual loop is to be ended has been issued. Incidentally, by means of the relevant loop output termination instruction, the value of the flag Manual is set to "0" (refer to FIG. 3).

In this case (S11: "from on to off"), the CPU 1 stops the loop output by means of a manual loop, restoration should be made to a normal performance, the value of the flag Loop Sw is set to "0"; and, together with this (S14), an instruction is issued to the DSP 10 for the termination of the relevant loop output (S15). Due to this termination instruction, the DSP outputs the waveform data that have been supplied from the CPU 1 to the outside from a speaker and the like via the D/A 12 while storing the supplied waveform data in the buffer (refer to FIG. 4(*a*)).

After the instruction has been issued to the DSP 10 in the processing of S15, the CPU 1 returns to the processing of S7 and repeatedly executes each of the processes from S7 and on during the time until a determination is made that the value of the readout address Adrs exceeds the value of the end point End (S9: no), in other words, that the readout of all of the waveform data from the flash ROM 4 has been completed.

FIG. 7 is a flowchart that shows the processing that is launched by the timer interrupts of the times "T1" and "T2." This timer interrupt processing is processing that is executed by the CPU 1 and is executed in those cases where a determination has been made that the timing of the time "T1" that has been set by the processing of S6 discussed above or the time "T2" that is set by the processing of S36, which will be discussed later, has arrived, in other words, the timing with which the loop output by means of an automatic loop is started or ended.

With regard to the timer interrupt processing, the CPU 1 first makes a determination as to whether or not the value of the flag Auto is "0" (S31). In those cases where the result of the determination is that the value of the flag Auto is "0" (S31: yes), since this is the timing with which the loop output by means of an automatic loop is started (refer to FIG. 3) and from this point on, the fact that a loop output by means of an automatic loop is in the midst of execution should be indicated, the value of the flag Auto is set to "1" (S32) and the processing moves to the processing of S33.

In the processing of S33, a determination is made as to whether or not the value of the flag Manual is "0," in other words, whether or not a loop output by means of a manual loop is already being carried out (S33). In those cases where the result is that a determination is made that value of the flag Manual is "0" (S33: yes), since a loop output by means of manual loop is not being carried out (refer to FIG. 3), the time T3, which is determined by the parameter Loop Length, is set in the timer 2 and the length of the sound that is looped (in other words, the length of the segment from the time "T1" in FIG. 3 to the time "T3") is set. In those cases where, in the processing of S33, a determination is made that the value of the flag Manual is "1" (S33: no), since a loop output by means of a manual loop is already being carried out (refer to FIG. 3) and there is no need to set the time "T3" (S34) and to issue a start instruction to the DSP 10 (S35), the processing of S34 and S35 is skipped and the processing moves to the processing of S36.

Incidentally, in those cases where a determination has been made from the clock of timer 2 that the timing of the time T3 has arrived, the CPU 1 interrupts the control that is being executed, executes the timer interrupt processing that is shown in the flowchart of FIG. 6 discussed above, and the value of the flag Loop Sw is set to "1" (refer to FIG. 6).

In addition, after the time T3 has been set in the processing of S34, a loop output by means of an automatic loop should be started and the CPU 1 issues an instruction to the DSP 10 to start the relevant loop output (S35), and the processing moves to the processing of S36. Due to the start instruction, the DSP 10, as discussed above, outputs the waveform data that have been supplied from the CPU 1 to the outside from a speaker and the like via the D/A 12 while storing the supplied waveform data in the buffer during the time that the flag Loop Sw is "0" (in other words, during the time from the time "T1" in FIG. 3 until the time "T3").

In addition, in those cases where the flag Loop Sw has become "1" (in other words, during the time from the time "T3" in FIG. 3 to the time "T2"), the signal that is stored in the buffer discussed above (the signal 40*a* that corresponds to the segment from the time "T1" in FIG. 3 to the time "T3") is repeatedly read out and the signal that has been read out is output to the outside from a speaker and the like via the D/A 12.

Thus the effect system of the present embodiment applies to the waveform data an effect in which the signal of a specified segment of the waveform data (in other words, the length that the performer has set by means of the parameter Loop Length) from a specified timing (in other words, a timing that the performer has set by means of the parameter Timing) is repeatedly output in real time only during a specified time interval (in other words, as will be discussed later, until the time that has been set by the performer by means of the parameter Hold).

In the processing of S36, the time "T2" is set in the timer 1 (S6). The time "T2" is a time that expresses the timing at which the loop output by means of an automatic loop ends (refer to FIG. 3) and is set by the parameter Hold. In those cases where a determination is made by means of the clock of the timer 1 that the timing of the time "T2" has arrived, the CPU 1 interrupts the control that is being executed and executes the timer interrupt processing again. After the completion of the processing of S36, the timer interrupt processing ends.

On the other hand, in those cases where, in the processing of S31, a determination is made that the value of the flag Auto is "1" (S31: no), since this is the timing at which the loop output by means of an automatic loop ends (refer to FIG. 3) and from this point on, the completion of the loop output by means of an automatic loop should be indicated, the value of the flag Auto is set to "0" (S37) and the processing moves to the processing of S38.

In the processing of S38, a determination is made as to whether or not the value of the flag Manual is "0," in other words, whether or not the system is in the midst of a loop output by means of a manual loop (S38). In those cases where the result is that a determination is made that the value of the flag Manual is "0" (S38: yes), since the system is not in the midst of a loop output by means of a manual loop (refer to FIG. 3), the loop output by means of an automatic loop ends, restoration should be made to a normal performance, the value of the flag Loop Sw is set to "0," and, together with this (S39), an instruction is issued to the DSP 10 for the termination of the relevant loop output (S40) and the timer interrupt processing ends. In those cases where in the processing of S38 a determination is made that the value of the flag Manual is "1" (S38: no), the system is in the midst of a loop output by means of a manual loop (refer to FIG. 3), and since there is no need to modify the value of the flag Loop Sw (S39) and to issue a termination instruction to the DSP 10 (S40), the processing of S39 and S40 is skipped and the timer interrupt processing ends.

Due to the termination instruction, the DSP 10 outputs the waveform data that are supplied: from the CPU 1 to the outside from a speaker and the like via the D/A 12 while the supplied waveform data are stored in the buffer.

After the timer interrupt processing that is shown in FIG. 7 ends, the control returns to the position of the interruption of the control that was being executed prior to the interruption and the control resumes from that interrupt position.

An explanation has been given above of the present invention based on a preferred embodiment but the present invention is in no way limited to the preferred embodiment discussed above and the possibility of various modifications and variations can be easily conceived of that do not deviate from and are within the scope of the essentials of the present invention.

For example, with the effect system of this preferred embodiment, an explanation has been given of the case in which the length of the segment in which the signal of a specified segment (the signal 40*a* of FIG. 3) is loop output and continues is instructed as a time interval by the parameter Hold. However, the system is not necessarily limited to this; and, for example, it is, of course, possible for the system to be configured such that a parameter that sets a count is provided and the signal of the specified segment is loop output only the number of times that has been instructed by that parameter. In this case, since, if the count is designated large, the length of the segment in which the loop output continues becomes long and if the count is designated small, the length of the segment in which the loop output continues becomes short, even if the system is configured such that a count is designated, it is possible to set the same sensation as in the case in which a time interval is designated.

In addition, for example, with the effect system of this preferred embodiment, an explanation was given in which the value of the parameter Loop Length is one that is fixed during the performance. However, the system is not necessarily limited to this; and, for example, it is, of course, possible for a knob operator (or a pedal operator) to be provided as the VR 8 (refer to FIG. 1) to which the parameter Loop Length is assigned and, by making the value of the parameter Loop Length continuously variable in conformance with the amount of operation of the relevant knob operator, make it possible for the length of the signal of the specified segment (the signal 40*a* of FIG. 3) to be varied in real time during the performance.

In this case, the buffer amount of the loop buffer RB that is shown in FIG. 4 can be continuously varied by the amount of operation of the knob operator and the like (in other words, the value of the parameter Loop Length). Incidentally, in the state that is shown in FIG. 4(*b*) (in other words, in the midst of a loop output), in those cases where the knob operator and the like has been operated and the readout segment of the loop buffer RB has been extended, it may also be configured such that the relevant extended segment is output without sound. Or else, it may be configured with the loop buffer RB structured as a ring buffer and by feeding back the data that have been read out and again storing this in the memory, such that the output of the extended segment described above without sound is avoided.

What is claimed is:

1. An effect system that applies an effect to an audio signal, comprising:

segment designation means for designating a segment of an input signal;

storage means for storing the segment;

first time interval designation means for designating a time interval during which the segment is to be repeatedly output;

loop output means for repeatedly reading and outputting the segment during the time interval;

tempo designation means for designating a tempo of the input signal;

timing designation means for designating the timing of the beginning of the segment with respect to a designated tempo; and second time interval designation means for designating a length of the segment with respect to a designated tempo, wherein the system is configured such that the segment designation means designates a segment of the input signal based on the timing that has been designated by the timing designation means and the length that has been designated by the second time interval designation means.

2. The effect system claimed in claim 1, wherein the previously mentioned first time interval designation means designates the time interval during which the segment is to be repeatedly output as a type of note with respect to a tempo designated by the tempo designation means.

3. An effect system that applies an effect to an audio signal, comprising:

segment designation means for designating a segment of an input signal;

storage means for storing the segment;

count designation means for designating a number of times to output the segment;

loop output means for reading and outputting the segment a number of times designated by the count designation means;

tempo designation means for designating a tempo of the input signal;

timing designation means for designating the timing of the beginning of the segment with respect to a designated tempo; and time interval designation means for designating a length of the segment with respect to a designated tempo, wherein the system is configured such that the segment designation means designates a segment of the input signal based on the timing that has been designated by the timing designation means and the length that has been designated by the time interval designation means.

4. A programmable effect device that applies a loop effect to an audio signal, the device comprising a computer readable medium storing programming code for controlling the device to perform processing comprising:

receiving user input specifying a start time of a segment of an audio signal;

receiving user input specifying a duration of the segment;

receiving user input specifying an interval in which the segment is to be repeatedly output;

storing a segment of an input audio signal in accordance with the specified start time and duration; and repeatedly outputting the stored segment during the specified interval in accordance with the specified interval;

wherein the user input specifying a start time of the segment indicates a note location within the audio signal with respect to a tempo of the audio signal.

5. The effect device claimed in claim 4, wherein the processing further comprises receiving user input specifying a tempo of the audio signal, and wherein the segment is stored by identifying the start time of the segment from the user specified note location with respect to the user specified tempo.

6. The effect device claimed in claim 4, wherein the audio signal includes tempo information, and wherein the segment is stored by identifying the start time of the segment from the user specified note location with respect to the tempo information of the audio signal.

7. A programmable effect device that applies a loop effect to an audio signal, the device comprising a computer readable medium storing programming code for controlling the device to perform processing comprising:

receiving user input specifying a start time of a segment of an audio signal;

receiving user input specifying a duration of the segment;

receiving user input specifying an interval in which the segment is to be repeatedly output;

storing a segment of an input audio signal in accordance with the specified start time and duration; and repeatedly outputting the stored segment during the specified interval in accordance with the specified interval;

wherein the user input specifying a start time is a manual start signal generated by the user during performance of the audio signal.

8. A programmable effect device that applies a loop effect to an audio signal, the device comprising a computer readable medium storing programming code for controlling the device to perform processing comprising:

receiving user input specifying a start time of a segment of an audio signal;

receiving user input specifying a duration of the segment;

receiving user input specifying an interval in which the segment is to be repeatedly output;

storing a segment of an input audio signal in accordance with the specified start time and duration; and repeatedly outputting the stored segment during the specified interval in accordance with the specified interval;

wherein the user input specifying the length of the segment indicates the length of the segment as a musical time interval with respect to a tempo of the audio signal.

9. The effect device claimed in claim 8, wherein the segment is stored by identifying the end of the segment from the user specified musical time interval with respect to a user specified tempo.

10. The effect device claimed in claim 8, wherein the segment is stored by identifying the end of the segment from the user specified musical time interval with respect to the tempo information included in the audio signal.

11. A programmable effect device that applies a loop effect to an audio signal, the device comprising a computer readable medium storing programming code for controlling the device to perform processing comprising:

receiving user input specifying a start time of a segment of an audio signal;

receiving user input specifying a duration of the segment;

receiving user input specifying an interval in which the segment is to be repeatedly output;

storing a segment of an input audio signal in accordance with the specified start time and duration; and repeatedly outputting the stored segment during the specified interval in accordance with the specified interval;

wherein the user input specifying the interval in which the segment is to be repeatedly output indicates a musical time interval with respect to a tempo of the audio signal.

12. The effect device claimed in claim 11, wherein the segment is repeatedly output until the end of an interval determined from the user specified musical time interval with respect to a user specified tempo.

13. A programmable effect device that applies a loop effect to an audio signal, the device comprising a computer readable medium storing programming code for controlling the device to perform processing comprising:

receiving user input specifying a start time of a segment of an audio signal;

receiving user input specifying a duration of the segment;

receiving user input specifying an interval in which the segment is to be repeatedly output;

storing a segment of an input audio signal in accordance with the specified start time and duration; and repeatedly outputting the stored segment during the specified interval in accordance with the specified interval;

wherein the segment is repeatedly output until the end of an interval determined from the user specified musical time interval with respect to the tempo information included in the audio signal.

14. The effect device claimed in claim 4, wherein the user input specifying the interval in which the segment is to be repeatedly output indicates a number of times to output the segment.

15. A programmable effect device that applies a loop effect to an audio signal, the device comprising a computer readable medium storing programming code for controlling the device to perform processing comprising:

receiving user input specifying a start time of a segment of an audio signal;

receiving user input specifying a duration of the segment;

receiving user input specifying an interval in which the segment is to be repeatedly output;

storing a segment of an input audio signal in accordance with the specified start time and duration; and repeatedly outputting the stored segment during the specified interval in accordance with the specified interval;

wherein the processing further comprises terminating the repeated outputting of the stored segment in response to a user supplied manual stop command.

16. A programmable effect device that applies a loop effect to an audio signal, the device comprising a computer readable medium storing programming code for controlling the device to perform processing comprising:

receiving user input specifying a start time of a segment of an audio signal;

receiving user input specifying a duration of the segment;

receiving user input specifying an interval in which the segment is to be repeatedly output;

storing a segment of an input audio signal in accordance with the specified start time and duration; and repeatedly outputting the stored segment during the specified interval in accordance with the specified interval;

wherein the processing further comprises receiving user input specifying that the effect is to be synchronized to tempo data included in the audio signal.

17. The effect device claimed in claim 4, wherein the processing further comprises receiving user input specifying a tempo of the audio signal.

* * * * *